US005982606A

United States Patent [19]

Masuda et al.

[11] Patent Number: 5,982,606

[45] Date of Patent: Nov. 9, 1999

[54] ELECTRIC CHARGING MEMBER AND ELECTRIC CHARGING APPARATUS

[75] Inventors: Yoshitomo Masuda, Hamura; Gaku Yakushiji, Kodaira; Yasushi Inoue, Fujisawa; Minoru Satoyoshi, Yokohama, all of Japan

[73] Assignee: Bridgestone Corporation, Tokyo, Japan

[21] Appl. No.: 09/063,186

[22] Filed: Apr. 21, 1998

[30] Foreign Application Priority Data

| | | | |
|---|---|---|---|
| Apr. 21, 1997 | [JP] | Japan | 9-117598 |
| May 20, 1997 | [JP] | Japan | 9-145969 |
| Sep. 3, 1997 | [JP] | Japan | 9-254324 |

[51] Int. Cl.[6] ..... G03G 15/02

[52] U.S. Cl. ..... 361/225; 361/230; 399/176

[58] Field of Search ..... 361/220–222, 361/225, 230; 399/168, 174–176

[56] References Cited

U.S. PATENT DOCUMENTS

| | | | |
|---|---|---|---|
| 5,384,626 | 1/1995 | Kugoh et al. | 361/225 |
| 5,659,854 | 8/1997 | Masuda et al. | 361/221 |
| 5,713,067 | 1/1998 | Mizoe et al. | 399/176 |
| 5,744,276 | 4/1998 | Ohno et al. | 430/109 |

*Primary Examiner*—Fritz Fleming

*Attorney, Agent, or Firm*—Sughrue, Mion, Zinn, Macpeak & Seas, PLLC

[57] ABSTRACT

Disclosed is an electric charging member for charging a body to be charged by bringing the electric charging member in contact with the body to be charged and applying a voltage between the electric charging member and the body to be charged, including: an elastic layer; and a covering layer formed on the outer side of the elastic member directly or through another layer; wherein the covering layer is formed of a coating having a storage modulus (G') in a range of $1\times10^7$ dyn/cm$^2$ or less, and also having tan δ, expressed by a ratio (G"/G') of a loss modulus (G") to the storage modulus (G'), in a range of 0.01 to 0.4. The electric charging member is allowed to suppress occurrence of compressive deformation and to reduce noise due to electrification.

20 Claims, 1 Drawing Sheet

ELECTRIC CHARGING MEMBER AND ELECTRIC CHARGING APPARATUS

BACKGROUND OF THE INVENTION

The present invention relates to an electric charging member and an electric charging apparatus suitable for charging a body to be charged such as a photosensitive body in an electrostatic latent image forming process performed in an electrophotographic system such as a copying machine or a printer.

In an electrostatic latent image forming process performed in an electrophotographic system such as a copying machine or a printer, an electrostatic latent image is formed by uniformly charging a surface of a photosensitive body, and projecting an image from an optical system on the photosensitive body to erase the electrification on a portion on which light is incident, to thereby form an electrostatic latent image. The electrostatic latent image is then stuck with toner to form a toner image, and the toner image is transferred, that is, printed on a recording medium such as paper.

In this case, th first operation of charging a photosensitive body has been generally performed using a corona discharge method. The corona discharge method is undesirable in terms of safety and maintenance of the machine because it requires application of a high voltage of 6 to 10 kV. The corona discharge method also presents an environmental problem because of occurrence of toxic substances such as ozone and $NO_x$ during corona discharge.

For this reason, attempts have been made to develop a new charging method capable of charging a body to be charged at a voltage lower than that required for corona discharge and of suppressing occurrence of toxic substances such as ozone. As such a new charging method, there has been proposed a contact-type method of charging a body to be charged by bringing an electric charging member applied with a voltage with the body to be charged at a specific pressure.

As the electric charging member used for the above contact-type charging method, there has been known a member formed by coating the surface of an elastic layer made from a rubber or urethane foam with a resin solution in which a resin such as a polyurethane or nylon is dissolved in an organic solvent by a dipping process or a spraying process, to form a covering layer of the resin such as a polyurethane or nylon for ensuring surface smoothness and preventing adhesion of toner.

In the contact-type charging method, however, since the electric charging member is in press-contact with a body to be charged such as a photosensitive body for a long period, the electric charging member is liable to be deformed, and if the deformed state is returned to the original one, there occurs an improper image. As a result, an elastic body and a coating constituting the electric charging member are required to be small in compression set.

Incidentally, in the contact-type charging method, a dc voltage is often superimposed with an ac voltage for stably keeping uniform electrifying charges on a body to be charged. In this case, however, when an ac voltage is applied in a state in which the electric charging member is in contact with the body to be charged, there occurs such a phenomenon that the body to be charged is tapped by the electric charging member by application of the ac voltage, leading to occurrence of noise. To cope with such an inconvenience, the hardness of the surface of the electric charging member is required to be reduced.

In this case, to reduce the compression set of the electric charging member, the elasticity of the coating may be made larger by crosslinking the resin for forming the coating; however, when the resin for forming the coating is crosslinked, the hardness of the coating becomes higher. As a result, there occur inconveniences that noise becomes larger and the surface of a body to be charged such as a photosensitive body in direct-contact with the coating is scratched.

On the other hand, to reduce the hardness of the electric charging member, a plasticizer or a softening agent may be added to a rubber material or a foam material for forming the elastic layer. In this case, however, there occurs a problem that the added plasticizer or softening agent will possibly bleed, leading to contamination of the body to be charged such as a photosensitive body.

In this way, according to the conventional methods, it is difficult to reduce noise while keeping an excellent charging performance by making prevention of deformation compatible with reduction in hardness for the electric charging member.

SUMMARY OF THE INVENTION

An object of the present invention is to provide an electric charging member capable of suppressing deformation so as to prevent occurrence of an improper image due to deformation, and sufficiently reducing the surface hardness to prevent inconveniences such as occurrence of noise and scratches of a body to be charged, and an electric charging apparatus using the electric charging member.

The present inventors have examined to achieve the above object and found that in an electric charging member including an elastic layer and a covering layer formed on the outer side of the elastic member directly or through another layer, compressive deformation and occurrence of noise due to electrification can be controlled by adjusting a relationship between a storage modulus (G') and a loss modulus (G") of the covering layer, and have further examined and found that an electric charging member capable of suppressing compressive deformation and reducing noise due to electrification can be obtained by a method wherein the above covering layer is formed of a coating having a storage modulus (G') in a range of $1\times10^7$ dyn/cm$^2$ or less, and also having tan δ, expressed by a ratio (G"/G') of a loss modulus (G") to the storage modulus (G'), in a range of 0.01 to 0.4.

To be more specific, the above-described tan δ, which is expressed by a ratio (G"/G') of a loss modulus (G") to the storage modulus (G'), indicates a ratio of a viscosity characteristic to an elastic characteristic. Accordingly, for a resin material for forming the above covering layer, the increased tan δ means that the compression set becomes larger because of the increased contribution of viscosity and thereby the deformed amount of the electric charging member becomes larger, while the decreased tan δ means that the deformed amount becomes smaller but noise upon application of a voltage becomes larger because of the increased contribution of elasticity. Here, to realize an ideal covering layer of an electric charging member, it is required to reduce the viscosity and the elasticity of the covering layer. Also it is expected that there exist preferable ranges of the tan δ and G' for realizing an ideal covering layer of an electric charging member. The present inventors have variously examined to find out these preferable ranges of the tan δ and G'and found the above-described specific ranges of the tan δ and G'.

According to a first aspect of the present invention, there is provided an electric charging member for charging a body to be charged by bringing the electric charging member in contact with the body to be charged and applying a voltage between the electric charging member and the body to be charged, including: an elastic layer; and a covering layer formed on the outer side of the elastic member directly or through another layer; wherein the covering layer is formed of a coating having a storage modulus (G') in a range of $1\times10^7$ dyn/cm$^2$ or less, and also having tan δ, expressed by a ratio (G"/G') of a loss modulus (G") to the storage modulus (G'), in a range of 0.01 to 0.4.

The present inventors have further examined and found that an electric charging member, which has a low surface hardness of 80 or less in micro-hardness although being small in compression set and thereby being less deformed, can be obtained by a method wherein the above covering layer is formed of an aqueous coating obtained by crosslinking a resin having active hydrogen such as a carboxyl group, hydroxyl group, amino group or the like with an epoxy based crosslinking agent having two or more of epoxy groups or an oxazoline based crosslinking agent having two or more of oxazoline groups, and that an electric charging apparatus using the above electric charging member is allowed to certainly, highly prevent deformation, reduce noise, prevent occurrence of scratches of a body to be charged, and the like.

Accordingly, in a preferred embodiment of the present invention, there is provided the electric charging member in which the covering layer is an aqueous coating formed by crosslinking a resin having active hydrogen with an oxazoline based crosslinking agent having two or more of oxazoline groups; or the covering layer is an aqueous coating formed by crosslinking a resin having active hydrogen with an epoxy based crosslinking agent having two or more of epoxy groups.

According to a second aspect of the present invention, there is provided an electric charging apparatus including: an electric charging member for charging a body to be charged in a state in which the electric charging member is in contact with the body to be charged; and a voltage applying means for applying a voltage between the body to be charged and the electric charging member; wherein the above-described electric charging member is used for the electric charging apparatus.

DETAILED DESCRIPTION OF THE PREFERRED EMBODIMENTS

Figure 1:
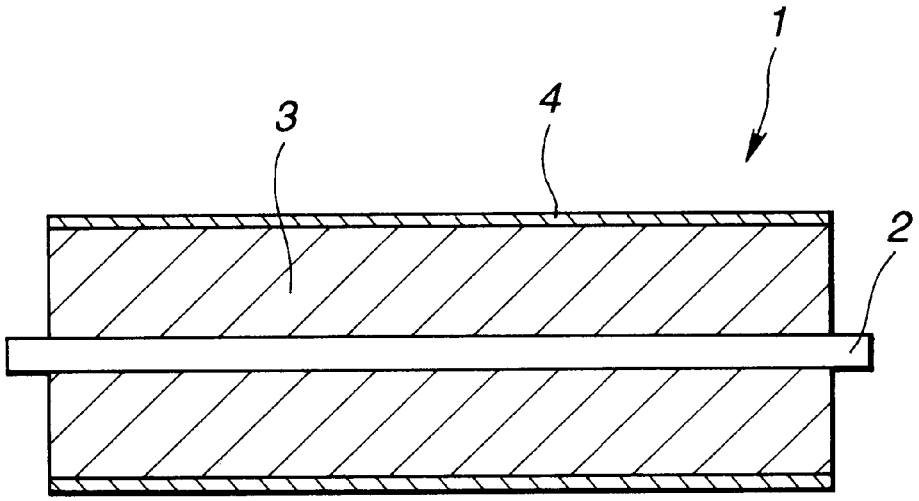
FIG. 1 is a sectional view showing one example of an electric charging member of the present invention.

Hereinafter, the present invention will be described in detail.

An electric charging member of the present invention has an elastic layer and a covering layer formed on the outer side of the elastic layer. The electric charging member may be formed in any shape insofar as it is stably brought in contact with a body to be charged and uniformly gives charges to the body to be charged, for example, it may be formed into a roll-shape, plate-shape, block-shape, spherical-shape, or brush-shape. In general, the electric charging member may be preferably formed into a roll-shape. In the case where the electric charging member is formed into a roll-shape, it may be represented by an electric charging member 1 shown in FIG. 1, in which an elastic layer 3 is formed around an outer periphery of a shaft 2 and a covering layer 4 is formed on the outer side of the elastic layer 3. In this case, for the shaft 2, there may be used a shaft made from a metal or plastic. The shaft 2 can be omitted depending on the shape of the electric charging member and the mechanism of an electric charging apparatus using the electric charging member.

The elastic layer 3 may be, while not exclusively, made from a rubber, a resin, or a foaming body (hereinafter, referred to as "a foam") thereof. More specifically, the elastic layer 3 may be made from a rubber composition containing a base rubber such as a polyurethane, silicon rubber, butadiene rubber, isoprene rubber, chloroprene rubber, styrene-butadiene rubber, ethylene-propylene rubber, polynorbornane rubber, stylene-butadiene-stylene rubber, or epichlorohydrin rubber. In particular, a polyurethane is preferably used, and more preferably, a polyurethane foam having an expansion ratio of 1.5 to 50 is used. The density of the foam may be in a range of 0.05 to 0.9 g/cm$^3$.

A conductive material can be added in the elastic layer 3 for giving a conductivity thereto. Specific examples of the conductive materials may include, while not exclusively, a cationic surface active agent, for example, a quaternary ammonium salt such as a perchlorate, chlorate, borofluoride, sulfate, ethosulfate, benzyl halide (for example, benzyl bromide or benzyl chloride) of lauryl trimethylammonium, stearyl trimethylammonium, octadecyl trimethylammonium, dodecyl trimethylammonium, hexadecyl trimethylammonium, or modified fatty acid-dimethylethyl ammonium; an anionic surface active agent such as an aliphatic sulfonate, higher alcohol sulfate, higher alcohol sulfate added with ethylene oxide, higher alcohol phosphate, or higher alcohol phosphate added with ethylene oxide; an amphoteric surface active agent such as betaine; an anti-static agent, for example, a non-ionic anti-static agent such as higher alcohol ethylene oxide, polyethyleneglycol fatty acid ester, or polyhydric alcohol fatty acid ester; a salt of a group I metal such as $Li^+$, $Na^+$, or $K^+$, for example, $LiCF_3SO_3$, $NaClO_4$, $LiAsF_6$, $LiBF_4$, NaSCN, KSCN, or NaCl, an electrolyte such as $NH_4^+$, a salt of a group II metal such as $Ca^{2+}$ or $Ba^{2+}$, for example, $Ca(ClO_4)_2$, or the above anti-static agent having one or more groups (hydroxyl group, carboxyl group, primary or secondary amine group) containing active hydrogen reacting with isocyanate; an ionic conductor agent such as a complex of the above material and a polyhydric alcohol (1,4-butanediol, ethylene glycol, polyethylene glycol, propylene glycol or the like) or its derivative, or a complex of the above material and monool such as ethyleneglycol monomethylether, ethyleneglycol monoethylether or the like; conductive carbon such as ketchen black or acetylene black; rubber carbon such as SAF, ISAF, HAF, FEF, GPF, SRF, FT or MT; color (ink) carbon subjected to oxidation, pyrolytic carbon, natural graphite, or artificial graphite; metal and metal oxide such as tin oxide doped antimony, titanium oxide, zinc oxide, nickel, copper, silver or germanium; and a conductive polymer such as polyaniline, polypyrrole or polyacetylene. In this case, the content of the conductive agent is suitably selected in accordance with the kind of a rubber or a resin as a base material or the kind of the conductive agent, and more specifically, it may be adjusted such that the volume resistivity of the elastic layer 3 is in a range of $10^0$ to $10^8$ Ωcm, preferably, in a range of $10^2$ to $10^6$ Ωcm.

The covering layer 4, which is a coating having the storage modulus (G') and the value of tan δ as described above, is usually made from a resin added with a conductive agent. As the resin for forming the above coating, there may be used any kind of resin insofar as it can be added with a conductive agent. In the case where the coating is formed directly on the elastic layer 3, it is preferably but not exclusively made from an aqueous resin for ensuring the smoothness of the coating. As the aqueous resin, if water is used as a solvent, there may be used any one of a water-soluble type, an emulsion type, and a suspension type, and particularly, there may be preferably used a resin having active hydrogen such as carboxyl group, hydroxyl group or amino group. Specific examples of these aqueous resins may include resins such as a polyester based resin, an acrylic based resin, a urethane based resin, and polydioxolan. In particular, an acrylic resin is preferably used as the above aqueous resin because it is quite smaller in dielectric constant, that is, smaller in electrostatic capacity than a polyurethane or nylon which has been generally used for an electric charging member. It is effective to reduce an electrically attractive force/repulsive force between an electric charging member and a body to be charged when a dc voltage is applied therebetween and hence to lower noise due to electrification.

There may be preferably used an acrylic resin having a glass-transition temperature in a range of −60 to 20° C., particularly, in a range of −50 to 10° C., containing a carboxyl group and a hydroxyl group in an amount of 2 to 5 wt %, and being of a soap-free emulsion type, because of its excellent crosslinking characteristic and its reduced hardness. An acrylic resin is divided into a thermoplastic type and a crosslinking type, each of which can be preferably used. In particular, it is preferable to form the covering layer 4 by crosslinking a crosslinking type acrylic resin using a crosslinking agent which will be described later.

In the case of forming the covering layer 4 by crosslinking the above aqueous resin using a crosslinking agent, while not exclusively, it is preferable to form the covering layer 4 by crosslinking an aqueous resin having active hydrogen using an epoxy based crosslinking agent having two or more of epoxy groups or an oxazoline based crosslinking agent having two or more of oxazoline groups.

The above epoxy based crosslinking agent may be of any type insofar as it has two or more of epoxy groups and is soluble in water. While not used exclusively, there may be preferably used an epoxy based crosslinking agent having alkylene oxide at its main chain because of its excellent affinity with the above aqueous resin. The number of epoxy functional groups of the epoxy based crosslinking agent is, preferably but not exclusively, in a range of 2 to 3. When the number of the functional groups is less than 2, the crosslinking density may be not increased. When the number of the functional groups is more than 3, the paint may be gelatinized. The chemical equivalent of the epoxy group may be, while not exclusively, in a range of 100 to 300, preferably, in a range of 150 to 280. When the chemical equivalent of the epoxy group is more than 300, the molecular weight becomes excessively larger, so that it may be difficult to handle the crosslinking agent at room temperature.

The above oxazoline based crosslinking agent may be of any type insofar as it has two or more of oxazoline groups and is soluble in water. While not used exclusively, there may be preferably used an oxazoline based crosslinking agent having the chemical equivalent of the oxazoline group in a range of 300 to 1,000, preferably, in a range of 400 to 800. When the chemical equivalent of the oxazoline group is more than 1,000, the molecular weight becomes excessively larger, so that there occurs an inconvenience that it is difficult to handle the crosslinking agent at room temperature. Besides, when the chemical equivalent of the oxazoline group is less than 300, the reactivity becomes excessively larger, so that there occurs an inconvenience that the paint may be gelatinized.

A conductive agent can be added to the covering layer 4 for imparting a conductivity to the covering layer 4 or to adjust the conductivity of the covering layer 4. In general, the conductivity of the covering layer 4 is preferably adjusted to set the volume resistivity in a range of $10^3$ to $10^{12}$ Ωcm, particularly, in a range of $10^5$ to $10^{10}$ Ωcm. In this case, there may be used the same conductive agents as those added to the elastic layer 3, and particularly, there may be preferably used carbon. The added amount of a conductive agent is suitably selected to obtain the above-described specific volume resistivity in accordance with the kind of the conductive agent. While not used exclusively, if carbon is used as a conductive agent, the added amount of the conductive agent may be usually set in a range of 0.01 to 60 wt %, particularly, in a range of about 10 to 40 wt %.

The covering layer 4 can be added with suitable additives such as a thickener, a thixotropy imparting agent, and a structural viscosity imparting agent in suitable amounts, as needed. In this case, each additive may be of an inorganic type or an organic type.

The thickness of the covering layer 4 is not particularly limited but is preferably thinned for maintaining the flexibility of the elastic layer 3. Concretely, the thickness of the covering layer 4 may be 1 mm or less, preferably, 800 μm or less, more preferably, in a range of 20 to 600 μm.

The covering layer 4 is, as described above, formed of a coating in which the storage modulus (G') is in a range of $1\times10^7$ dyn/cm$^2$ or less, and the value of tan δ expressed by a ratio (G"/G') between a loss modulus (G") and the storage modulus (G') is in a range of 0.01 to 0.4. The covering layer 4 may be preferably formed of a coating having the value of G'in a range of $1\times10^6$ to $1\times10^7$ dyn/cm$^2$ and the value of tan δ in a range of 0.1 to 0.4. The use of such a covering layer 4 realizes an electric charging member capable of suppressing occurrence of compressive deformation and noise due to electrification.

The storage modulus (G'), loss modulus (G") and tan δ, which are respectively the same as a "storage modulus ($G_1$)", "loss modulus ($G_2$)", and "loss factor (tan δ)" defined in "Testing Method for Dynamic Properties of Rubber Vulcanizates" specified under Japanese Industrial Standards (JIS) K6394, represent dynamic properties of the covering layer 4 due to sinusoidal vibration. These values G', G" and tan δ can be easily measured using a commercial viscoelasticity measuring device in accordance with a measuring procedure specified under JIS K6394.

The storage modulus (G'), loss modulus (G") and tan δ can be concretely obtained as follows. First, a film is formed using a paint for forming the coating 4, and is cut into a circular shape, to prepare a sample having a diameter of 10 mm and a thickness of 1 mm. The sample is then mounted on a viscoelasticity measuring device and is measured in terms of viscoelasticity at a measuring temperature of 40° C., a frequency of 0.05 Hz, and a distortion of 5%. The above values of G', G" and tan δ are obtained from the measured results. In addition, as the above viscoelasticity measuring device, there can be used a viscoelasticity measuring device (Reometrics RECAP II produced by Reometrics Corporation).

While not particularly shown in FIG. 1, the electric charging member of the present invention can be further so configured that one or more of outer layers are provided on the covering layer 4 in accordance with purposes for preventing adhesion of toner, ensuring the surface smoothness, and the like.

The outer layer may be made from a suitable resin in accordance with the purposes as described above, such as nylon, a polyester, urethane-modified acrylic resin, phenol resin, acrylic resin, epoxy resin, urethane resin, urea resin, or fluorocarbon resin. In particular, the outermost layer of the electric charging member may be preferably made from a fluorocarbon resin in terms of surface smoothness of the electric charging member and of low adhesion with a photosensitive body.

As the fluorocarbon resin, there may be used polytetrafluoroethylene, tetrafluoroethylene-perfluoroalkylvinylether-copolymer, tetrafluoroethylene-hexafluoropropyrene-perfluoroalkylvinylether-copolymer, tetrafluoroethylene-ethylene-copolymer, polychlorotrifluoroethylene, chlorotrifluoroethylene-ethylene-copolymer, polyvinylidenefluoride, or polyvinylfluoride. In particular, there may be used, preferably, an aqueous fluorocarbon resin of a dispersion type in which fine particles of the resin are dispersed in water, and more preferably, an aqueous fluorocarbon resin of a dispersion type in which fine particles of polytetrafluoroethylene are disposed in water. The particle size of fine particles of a fluorocarbon resin used may be, while not exclusively, in a range of 5 $\mu$m or less, preferably, in a range of 0.05 to 1 $\mu$m.

The outer layer can be made from the fluorocarbon resin mixed with other resins to such an extent as to reduce the effect of the fluorocarbon resin. Specific examples of the other resins may include a polyvinyl acetal resin, urethane resin, polyester resin, acrylic resin, nylon resin, epoxy resin, and vinylidene chloride based copolymer. One kind or two or more kinds of these resins may be added to a fluorocarbon resin, to form a mixed resin for forming the outer layer. Of these resins, in terms of coating characteristic and uniformity of resistance of a fluorocarbon resin, there may be used, preferably, a polyvinyl acetal resin, urethane resin, polyester resin, and vinylidene chloride based copolymer, more preferably, a polyvinyl acetal resin. In particular, a combination of an aqueous fluorocarbon resin and an aqueous polyvinyl acetal resin enables formation of uniform coating of the outer layer even when the weight ratio of the aqueous fluorocarbon resin is set at a high value. Further, a combination of an aqueous fluorocarbon resin and a vinylidene chloride based copolymer latex enables formation of uniform coating of the outer layer and also enhancement of a barrier characteristic and water tightness of the outer layer.

A conductive agent can be added to the outer layer for imparting a conductivity of the outer layer or adjusting the conductivity of the outer layer. The type of the conductive agent is not particularly limited. However, carbon may be preferably used. In particular, carbon may be preferably added as a conductive agent to the outermost layer forming the surface of an electric charging member. In this case, as carbon used for the outermost layer, while not exclusively, the content of oxygen is 5% or more, preferably, 7% or more, more preferably, 9% or more; and the pH is 5 or more, preferably, 6 or more, more preferably, 7 or more. To be more specific, ordinary carbon contains oxygen in an amount of about 0.1 to 3%, and although oxidized carbon is unusually present, it has a tendency that the pH is shifted to the acidic side along with a slight increase in content of oxygen. When such acidic carbon is added to an aqueous fluorocarbon resin, the stability of the aqueous fluorocarbon resin is possibly degraded. On the contrary, the above carbon suitably used for the present invention keeps neutral or alkaline property although it contains oxygen in a large amount, and therefore, such carbon can be stably added to an aqueous fluorocarbon resin. While the detailed structure of carbon having the above content of oxygen and the pH is unclear, there may be preferably used carbon in which a functional group such as a carboxyl group, hydroxyl group or a ketone group is present on the surface thereof and part of hydrogen of the functional group is replaced with an alkali metal such as sodium.

The amount of the above conductive agent added can be suitably adjusted to obtain a desired resistance. More specifically, the amount of the conductive agent added to the outer layer can be adjusted such that the volume resistivity of the outer layer may be in a range of $10^3$ to $10^{12}$ Ωcm, preferably, in a range of $10^5$ to $10^{10}$ Ωcm. In the case of where carbon is used as a conductive agent, the added amount of carbon may be set in a range of 0.01 to 40 wt %, preferably, in a range of 5 to 20 wt % on the basis of the weight of the outer layer.

The outer layer can be supplemental, like the covering layer 4, with suitable additives such as a thickener, a thixotropy imparting agent, and a structural viscosity imparting agent added in suitable amounts, as needed. In this case, each additive may be of an inorganic type or an organic type.

The thickness of the outer layer may be, while not exclusively, in a range of 30 $\mu$m or less, preferably, in a range of 5 to 15 $\mu$m. When the thickness of the outer layer is more than 30 $\mu$m, the hardness of the outer layer becomes excessively large, so that the flexibility thereof may be deteriorated, to lower the durability, tending to cause cracks in the outer layer in use.

The method of forming the covering layer 4 and the outer layer on the covering layer 4 as needed is not limited by coating of a paint: for instance the covering layer 4 may be formed by an extrusion. The covering layer 4 and the above outer layer may be formed by a variety of known means; however, these layers may be preferably formed by a method of preparing paints containing components forming these layers and applying the paints by a dipping process or a spraying process.

The electric charging member of the present invention, which has the elastic layer 3, the covering layer 4, and the outer layer provided on the covering layer 4 as needed, is formed in a roll shape as shown in FIG. 1. In such an electric charging member, a different layer may be further provided between the elastic layer 3 and the covering layer 4, as needed. For example, in the case where the elastic layer 3 is formed of a polyurethane foam, an intermediate layer may be provided for effectively preventing the occurrence of noise upon the application of a voltage and improving surface smoothness of the elastic layer 3. The intermediate layer is formed of a base material such as an acrylic resin, polyester resin, polyurethane resin, nylon resin, epoxy resin, urethane-modified acrylic resin, butyral resin, phenol resin, vinylidene chloride based copolymer, or polyvinyl acetal resin, wherein a conductive agent is added to the base material. In addition, according to the present invention, even if such an intermediate layer is not provided, it is possible to effectively suppress occurrence of noise by the function of the above covering layer, and hence to obtain a preferable stillness.

The electric charging member of the present invention has the covering layer 4 which is formed of the coating having the above-described physical properties, and accordingly, such an electric charging member is allowed to sufficiently reduce the surface hardness while suppressing the deformation. More specifically, to certainly prevent occurrence of noise and breakage of a photosensitive body or the like, the surface hardness (unit: micro-hardness, which will be described later) of the member may be in a range of 80 or less, preferably, in a range of 75 or less, more preferably, in a range of 50 to 75. According to the electric charging member of the present invention, even when the outer layer is formed on the covering layer 4, by setting the thickness or the like of the outer layer within the above-described range, the micro-hardness of the surface of the member can be specified in the above-described preferable range.

A hardness of a thin or small sample which has been difficult to be measured by a conventional hardness meter can be measured in micro-hardness. The micro-hardness is measured by pressing a probe having a diameter of 0.16 mm and a length of 0.5 mm onto a sample to give a deformation to the sample, and obtaining a hardness on the basis of the bitten amount (displacement) of the probe. Accordingly, by measuring the surface hardness of the electric charging member in micro-hardness, the hardness in a range being extremely shallow (thin) from the surface can be obtained as compared with the conventional case of measuring the surface hardness in Asker-C hardness. For the electric charging member of the present invention, the hardness in a range being extremely shallow from the surface can be made relatively low. Such a micro-hardness can be easily measured using a commercial micro-hardness meter, for example, a micro-hardness meter MD-1 produced by KOBUNSHI KEIKI CO., LTD.

The resistance of the electric charging member of the present invention may be suitably selected depending on an electric charging apparatus on which the member is mounted and a body to be charged, and is not particularly limited. However, to obtain a preferable image, the volume resistivity of the member may be in a range of $10^2$ to $10^{12}$ Ωcm, preferably, in a range of $10^5$ to $10^{10}$ Ωcm.

The electrostatic capacity of the electric charging member of the present invention may be, while not exclusively, in a range of $1\times10^{-9}$ F or less, preferably, $8\times10^{-10}$ F or less, more preferably, in a range of $6\times10^{-10}$ F or less, thereby effectively suppressing occurrence of noise upon charging operation. In this case, the electrostatic capacity of an electric charging member can be measured using an impedance analyzer or can be electrically measured using a metal drum as a mating member in contact with an electric charging member.

The method of measuring the electrostatic capacity will now be described in detail. First, the measurement using the impedance analyzer is performed as follows: namely, in the case of a roll-shaped electric charging member, the member is pushed on a high conductive plate or drum made from a metal; the impedance analyzer is connected between the roll-shaped electric charging member and the high conductive plate or drum; and the electrostatic capacity is calculated by the impedance analyzer.

The electric measurement using a metal drum as a mating member in contact with an electric charging member is a method of calculating the electrostatic capacity of the electric charging member while simulating a state in which the electric charging member is operated in a printer, copying machine or the like. For example, in the case of a roll-shaped electric charging member, the metal drum and the roll-shaped electric charging member in press-contact with the metal drum are rotated, and a voltage is applied between the metal drum and the member rotating in the press-contact state under a specific condition. In this case, the specific condition of the voltage is substantially the same as the condition of a voltage applied to an electric charging member in a printer or copying machine. For example, in the case of an organic photosensitive drum, a charging potential thereof is often about −700 V, and to supply such charging charges, a direct current of about 7 μA is allowed to flow to the roll-shaped electric charging member, and accordingly, by allowing such a current to flow to the roll-shaped electric charging member in contact with the metal drum, a dc resistance can be obtained. In some printer or copying machine, an alternating current is allowed to flow for keeping constant a charging potential. Such an alternating current is subjected to constant current control. In this case, by allowing such an alternating current to flow in the roll-shaped electric charging member in contact with the metal drum, an ac resistance can be obtained. Thus, the electrostatic capacity can be calculated by configurating a circuit model of the roll-shaped electric charging member into a parallel model of a dc resistance component and an electrostatic capacity component and substituting the above dc resistance value and the ac resistance value in the parallel model.

If the surface of an electric charging member has irregularities, recesses of the irregularities are clogged with toner, leading to occurrence of an improper image. As a result, the surface of the member may be preferably made as smooth as possible. Concretely, the surface roughness Rz (ten-point average roughness specified under JIS) of the member may be 4 μm or less, preferably, 3 μm or less, more preferably, 2 μm or less.

The electric charging member of the present invention is disposed in contact with a body to be charged such as a photosensitive body, and is adapted to charge the body to be charged by applying a voltage between the body to be charged and the electric charging member. In this case, the voltage applied between the electric charging member and the body to be charged may be either a dc voltage or an ac voltage. In particular, while not exclusively, a dc voltage superimposed with an ac voltage may be preferably applied between the electric charging member and the body to be charged for uniformly charging the body to be charged. The contact pressure between the electric charging member of the present invention and a body to be charged may be, while not exclusively, in a range of 50 to 2,000 g, preferably, in a range of 100 to 1,000 g, to thereby certainly realize desired electrification.

Figure 2:
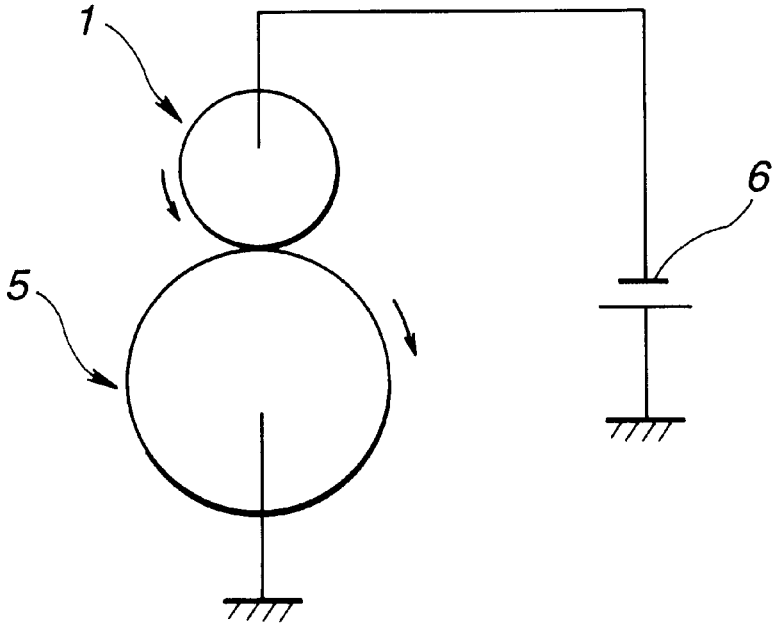
FIG. 2 is a schematic view showing one example of an electric charging apparatus of the present invention.

One example of the electric charging apparatus using the electric charging member of the present invention is shown in FIG. 2, in which an electric charging member 1 of the present invention is brought in contact with a body 5 to be charged such as a photosensitive drum and a voltage is applied between the member 1 and the body 5 to be charged by a voltage applying means 6. The electric charging apparatus of the present invention, however, is not limited thereto. For example, the forms of the body 5 to be charged and the electric charging member 1 and the voltage applying manner by the voltage applying means 6 may be suitably changed.

According to the electric charging member of the present invention, upon charging operation by the contact-type charging method, it is possible to suppress deformation and hence to prevent occurrence of an improper image due to deformation, and to sufficiently reduce the surface hardness and hence to effectively prevent inconveniences such as occurrence of noise and scratches of a body to be charged.

Accordingly, by use of the electric charging apparatus using the electric charging member of the present invention, a desired charging operation can be stably performed for a long period without occurrence of noise and scratches of a body to be charged.

EXAMPLE

The present invention will be more fully described by way of the following inventive examples and comparative examples. These examples, however, are for illustrative purposes only, and it is to be noted that the present invention is not limited thereto.

Example 1

A covering layer A having a thickness of 300 μm was formed on the surface of an elastic layer formed of a conductive urethane form (density: 0.48 g/cm$^3$) and an outer layer B having a thickness of 10 μm was formed on the surface of the covering layer A, to prepare a charging roller. The covering layer A and the outer layer B were formed as described below. For the charging roller thus obtained, the surface roughness Rz (ten-point average roughness specified under JIS) was 0.3 μm; the micro-hardness was 57; and the electrostatic capacity was $4\times10^{-10}$ F. In addition, the electrostatic capacity was measured by rotating the roller and a metal drum in press-contact with the roller, obtaining a dc resistance value on the basis of a dc voltage upon application of a direct current of 7 μA therebetween, measuring an ac voltage upon application of an alternating current of 560 μA therebetween, and calculating an electrostatic capacity with the roller taken as a parallel model of a dc resistance component and an electrostatic capacity component (the same is true for the following examples).

Covering Layer A

The covering layer A was formed by coating of a paint in which carbon and an epoxy based crosslinking agent having an alkylene oxide at its main chain (number of functional groups: 2, chemical equivalent of epoxy: 280) were added to an aqueous acrylic resin having a carboxyl group, wherein the volume resistivity was adjusted at $5\times10^7$ Ωcm. For the coating, the storage modulus (G') was $6\times10^6$ dyn/cm$^2$ and the tan δ was 0.23. The paint was stable without an increase in viscosity after an elapse of three days since preparation of the paint.

Outer Layer B

The outer layer B was formed by coating of a paint in which carbon was added to a blended resin of a water-dispersed type fluorocarbon resin, vinylidene chloride based copolymer latex, and polyvinyl acetal resin, wherein the volume resistivity was adjusted at $5\times10^7$ Ωcm. For the above carbon, the content of oxygen was 10%, and the pH value was 7.33.

The charging roller thus obtained was mounted on a printer, and was subjected to running test at a temperature of 15° C. and a moisture of 10% RH. As a result, preferable images were obtained. Further, 6,000 pieces of paper sheets were continuously printed, which gave the result that images were printed on the paper sheets without any deterioration thereof.

A charging operation was performed by rotating the charging roller in press-contact with a photosensitive body and applying a voltage of a dc voltage of −7.0 kV superimposed with an ac voltage Vpp of 2.0 kV (frequency: 500 Hz), and noise occurring during this charging operation was measured. As a result, the magnitude of noise was 50 dB. This means that there is no problem regarding noise.

The charging roller was brought in press-contact with a photosensitive body at a pressure of 1,000 g by applying a load of 500 g to each of both end portions of the charging roller, being left for three days at a temperature of 50° C. and a moisture of 95% RH, and then measured in terms of deformation at the contact portion using a laser outside diameter measuring device (produced by TOKYO SEIMITSU CORPORATION), which gave the result that the deformed amount was 20 μm. The roller after deformation testing was mounted on the printer and was then subjected to running test. As a result, it was found that images were printed without occurrence of any failure.

Example 2

A covering layer C having a thickness of 300 μm was formed on the surface of an elastic layer formed of the same conductive urethane foam as that in Example 1, and the same outer layer B as that in Example 1 was formed on the surface of the covering layer C, to prepare a charging roller. The above covering layer C was formed as described below. For the charging roller thus obtained, the surface roughness Rz (ten-point average roughness specified under JIS) was 0.3 μm, and the micro-hardness was 60.

Covering Layer C

The covering layer C was formed by coating of a paint in which carbon and an epoxy based crosslinking agent having an alkylene oxide at its main chain (number of functional groups: 2, chemical equivalent of epoxy: 195) were added to an aqueous acrylic resin having a carboxyl group like the covering layer A, wherein the volume resistivity was adjusted at $5\times10^7$ Ωcm. For the coating, the storage modulus (G') was $7.5\times10^6$ dyn/cm$^2$ and the tan δ was 0.25. The paint was stable without an increase in viscosity after three days since preparation of the paint.

The charging roller thus obtained was mounted on a printer, and was subjected to running test in the same manner as that in Example 1. As a result, preferable images were obtained. Further, 6,000 pieces of paper sheets were continuously printed, which gave the result that images were printed on the paper sheets without any deterioration thereof. The charging roller was then subjected to the same noise measuring test as that in Example 1. The magnitude of noise was 53 dB. This means that there is no problem regarding noise. The charging roller was further subjected to the same press-contact testing as that in Example 1, which gave the result that the deformed amount was 25 μm. The roller after testing was mounted on the printer and was then subjected to running test. As a result, it was found that images were printed without occurrence of any failure.

Example 3

A covering layer D having a thickness of 300 μm was formed on the surface of an elastic layer formed of the same conductive urethane foam as that in Example 1, and the same outer layer B as that in Example 1 was formed on the surface of the covering layer D, to prepare a charging roller. The above covering layer D was formed as described below. For the charging roller thus obtained, the surface roughness Rz (ten-point average roughness specified under JIS) was 0.3 μm; the micro-hardness was 65; and the electrostatic capacity was $5\times10^{-10}$ F.

Covering Layer D

The covering layer D was formed by coating of a paint in which carbon and an oxazoline based crosslinking agent (chemical equivalent of oxazoline: 550) were added to an aqueous acrylic resin having a carboxyl group like the covering layer A, wherein the volume resistivity was adjusted at $5\times10^7$ Ωcm. For the coating, the storage modulus (G') was $1\times10^7$ dyn/cm$^2$ and the tan δ was 0.33. The paint was stable without an increase in viscosity after an elapse of three days since preparation of the paint.

The charging roller thus obtained was mounted on a printer, and was subjected to running test in the same manner as that in Example 1. As a result, preferable images were obtained. Further, 6,000 pieces of paper sheets were continuously printed, which gave the result that images were printed on the paper sheets without any deterioration thereof. The charging roller was then subjected to the same noise measuring test as that in Example 1. The magnitude of noise was 55 dB. This means that there is no problem regarding noise. The charging roller was further subjected to the same press-contact testing as that in Example 1, which gave the result that the deformed amount was 25 μm. The roller after testing was mounted on the printer and was then subjected to a running test. As a result, it was found that images were printed without occurrence of any failure.

Example 4

A covering layer E having a thickness of 300 μm was formed on the surface of an elastic layer formed of the same conductive urethane foam as that in Example 1, and the same outer layer B as that in Example 1 was formed on the surface of the covering layer E, to prepare a charging roller. The above covering layer E was formed as described below. For the charging roller thus obtained, the surface roughness Rz (ten-point average roughness specified under JIS) was 0.3 μm, and the micro-hardness was 65.

Covering Layer E

The covering layer E was formed by coating of a paint in which carbon and an emulsion type oxazoline based crosslinking agent (chemical equivalent of oxazoline: 220) were added to an aqueous acrylic resin having a carboxyl group like the covering layer A, wherein the volume resistivity was adjusted at $5\times10^7$ Ωcm. For the coating, the storage modulus (G') was $9.1\times10^6$ dyn/cm$^2$ and the tan δ was 0.22. In addition, after being left at room temperature for one day, the paint was gelatinized and it was impossible to be used for coating of a paint. Accordingly, the paint must be prepared for each formation of the covering layer C, so that the covering layer C is poor in coating workability.

The charging roller thus obtained was mounted on a printer, and was subjected to running test in the same manner as that in Example 1. As a result, preferable images were obtained. Further, 6,000 pieces of paper sheets were continuously printed, which gave the result that images were printed on the paper sheets without any deterioration thereof. The charging roller was then subjected to the same noise measuring test as that in Example 1. The magnitude of noise was 58 dB. This means that there is no problem regarding noise. The charging roller was further subjected to the same press-contact testing as that in Example 1, which gave the result that the deformed amount was 15 μm. The roller after testing was mounted on the printer and was then subjected to running test. As a result, it was found that images were printed without occurrence of any failure.

Comparative Example 1

A covering layer F having a thickness of 300 μm was formed on the surface of an elastic layer formed of the same conductive urethane foam as that in Example 1, and the same outer layer B as that in Example 1 was formed on the surface of the covering layer F, to prepare a charging roller. The above covering layer F was formed as described below. For the charging roller thus obtained, the surface roughness Rz (ten-point average roughness specified under JIS) was 0.3 μm; the micro-hardness was 70; and the electrostatic capacity was $4\times10^{-10}$ F.

Covering Layer F

The covering layer F was formed by coating of a paint in which only carbon was added to an aqueous acrylic resin having a carboxyl group like the covering layer A, wherein the volume resistivity was adjusted at $5\times10^7$ Ωcm. For the coating, the storage modulus (G') was $3\times10^7$ dyn/cm$^2$ and the tan δ was 0.45.

The charging roller thus obtained was mounted on a printer, and was subjected to running test in the same manner as that in Example 1. As a result, preferable images were obtained. Further, 6,000 pieces of paper sheets were continuously printed, which gave the result that images were printed on the paper sheets with little deterioration thereof. The charging roller was then subjected to the same noise measuring test as that in Example 1. The magnitude of noise was 60 dB. This means that there is no problem regarding noise. However, as a result of the same press-contact test as that in Example 1, the deformed amount was as large as 50 μm. The roller after testing was mounted on the printer and was then subjected to running test. As a result, it was found that a banding pattern resulting from the deformation of the charging roller appeared on a half-tone image plane.

Comparative Example 2

A covering layer G having a thickness of 300 μm was formed on the surface of an elastic layer formed of the same conductive urethane foam as that in Example 1, and the same outer layer B as that in Example 1 was formed on the surface of the covering layer G, to prepare a charging roller. The above covering layer G was formed as described below. For the charging roller thus obtained, the surface roughness Rz (ten-point average roughness specified under JIS) was 0.3 μm; the micro-hardness was 75; and the electrostatic capacity was $5\times10^{-10}$ F.

Covering Layer G

The covering layer G was formed by coating of a paint in which carbon was added to a water-dispersed type urethane resin, wherein the volume resistivity was adjusted at $5\times10^7$ Ωcm. For the coating, the storage modulus (G') was $3\times10^7$ dyn/cm$^2$ and the tan δ was 0.15.

The charging roller thus obtained was mounted on a printer, and was subjected to running test in the same manner as that in Example 1. As a result, preferable images were obtained. Further, 6,000 pieces of paper sheets were continuously printed, which gave the result that images were printed on the paper sheets with little deterioration thereof. Then, the charging roller was subjected to the same noise measuring test as that in Example 1. The magnitude of noise was 70 dB. This means that noise at a high frequency occurs. The charging roller was further subjected to the same press-contact testing as that in Example 1, which gave the result that the deformed amount was 15 μm. The roller after testing was mounted on the printer and was then subjected to running test. As a result, it was found that images were printed without occurrence of any failure.

We claim:

1. An electric charging member for charging a body to be charged by bringing said electric charging member in contact with said body to be charged and applying a voltage between said electric charging member and said body to be charged, comprising:

an elastic layer; and a covering layer formed on the outer side of said elastic member directly or through another layer;

wherein said covering layer is formed of a coating having a storage modulus (G') in a range of $1\times10^7$ dyn/cm$^2$ or less, and also having tan δ, expressed by a ratio (G"/G') of a loss modulus (G") to the storage modulus (G'), in a range of 0.01 to 0.4.

2. An electric charging member according to claim 1, wherein said electric charging member has an electrostatic capacity in a range of $1\times10^{-9}$ F or less.

3. An electric charging member according to claim 1, wherein said covering layer is an aqueous coating formed by crosslinking a resin having active hydrogen with an epoxy based crosslinking agent having two or more of epoxy groups.

4. An electric charging member according to claim 3, wherein said epoxy based crosslinking agent has alkylene oxide at its main chain and also has two or three of epoxy functional groups.

5. An electric charging member according to claim 3, wherein said epoxy based crosslinking agent has the chemical equivalent of the epoxy group in a range of 100 to 300.

6. An electric charging member according to claim 1, wherein said covering layer is an aqueous coating formed by crosslinking a resin having active hydrogen with an oxazoline based crosslinking agent having two or more of oxazoline groups.

7. An electric charging member according to claim 6, wherein said oxazoline based crosslinking agent has the chemical equivalent of the oxazoline group in a range of 300 to 1,000.

8. An electric charging member according to claim 1, wherein said covering layer includes a layer containing an acrylic resin.

9. An electric charging member according to claim 1, wherein said covering layer is a coating, said coating containing an aqueous fluorocarbon resin added with carbon which contains oxygen in an amount of 5% or more and which has a pH value of 5 or more.

10. An electric charging member according to claim 1, wherein the surface of said electric charging member has a ten-point average roughness Rz specified under JIS in a range of 4 μm or less.

11. An electric charging member according to claim 1, wherein said elastic layer is formed of a polyurethane foam having a density in a range of 0.05 to 0.9 g/cm$^3$.

12. An electric charging member according to claim 1, wherein the surface of said electric charging member has a micro-hardness in a range of 80 or less.

13. An electric charging apparatus comprising:

an electric charging member for charging a body to be charged in a state in which said electric charging member is in contact with said body to be charged; and a voltage applying means for applying a voltage between said body to be charged and said electric charging member;

wherein said electric charging member comprises an elastic layer; and a covering layer formed on the outer side of said elastic member directly or through another layer;

wherein said covering layer is formed of a coating having a storage modulus (G') in a range of $1\times10^7$ dyn/cm$^2$ or less, and also having tan δ, expressed by a ratio (G"/G') of a loss modulus (G") to the storage modulus (G'), in a range of 0.01 to 0.4.

14. An electric charging apparatus according to claim 13, wherein said electric charging member has an electrostatic capacity in a range of $1\times10^{-9}$ F or less.

15. An electric charging apparatus according to claim 13, wherein said covering layer is an aqueous coating formed by crosslinking a resin having active hydrogen with an epoxy based crosslinking agent having two or more of epoxy groups.

16. An electric charging apparatus according to claim 13, wherein said covering layer is an aqueous coating formed by crosslinking a resin having active hydrogen with an oxazoline based crosslinking agent having two or more of oxazoline groups.

17. An electric charging apparatus according to claim 13, wherein said covering layer includes a layer containing an acrylic resin.

18. An electric charging apparatus according to claim 13, wherein the surface of said electric charging member has a ten-point average roughness Rz specified under JIS in a range of 4 μm or less.

19. An electric charging apparatus according to claim 13, wherein said elastic layer is formed of a polyurethane foam having a density in a range of 0.05 to 0.9 g/cm$^3$.

20. An electric charging apparatus according to claim 13, wherein the surface of said electric charging member has a micro-hardness in a range of 80 or less.

* * * * *